United States Patent [19]

Khoury

[11] 4,108,331

[45] Aug. 22, 1978

[54] NON-OBSTRUCTING END CLOSURE

[75] Inventor: Nick S. Khoury, Worth, Ill.

[73] Assignee: The Continental Group, Inc., New York, N.Y.

[21] Appl. No.: 776,562

[22] Filed: Mar. 11, 1977

Related U.S. Application Data

[63] Continuation of Ser. No. 737,928, Nov. 2, 1976, abandoned, which is a continuation-in-part of Ser. No. 684,620, May 10, 1976, abandoned.

[51] Int. Cl.[2] ..... B65D 41/32

[52] U.S. Cl. ..... 220/269; 220/273

[58] Field of Search ..... 220/266–269, 220/273

[56] References Cited

U.S. PATENT DOCUMENTS

| | | | |
|---|---|---|---|
| Re. 27,518 | 10/1972 | Brown | 220/269 |
| 3,338,461 | 8/1967 | Cookson | 220/269 |
| 3,684,126 | 8/1972 | Reichert | 220/273 |
| 3,744,666 | 7/1973 | Heffner | 220/269 |
| 3,795,342 | 3/1974 | Ashton | 220/269 |
| 3,796,344 | 3/1974 | De Phillips et al. | 220/269 |
| 3,838,788 | 10/1974 | Stargell | 220/273 X |
| 3,843,012 | 10/1974 | Brown | 220/269 |
| 3,977,561 | 8/1976 | Strobe et al. | 220/269 |
| 4,015,744 | 4/1977 | Brown | 220/269 |
| 4,022,346 | 5/1977 | Khoury | 220/273 |
| 4,030,631 | 6/1977 | Brown | 220/269 |

*Primary Examiner*—Stephen Marcus

*Attorney, Agent, or Firm*—John J. Kowalik; Joseph E. Kerwin; William A. Dittmann

[57] ABSTRACT

An improved non-detachable easy-opening end closure wherein the pull tab includes an integral strap member co-operating with the tab attachment rivet to limit the angular displacement of the tab relative to the opening flap, whereby the tab protrusion of the opened end closure is minimized and the tab is more securely attached to the end panel and which also functions to cause the tab and flap to move into the container during opening to a position where it is non-obstructive.

28 Claims, 14 Drawing Figures

FIG. 1
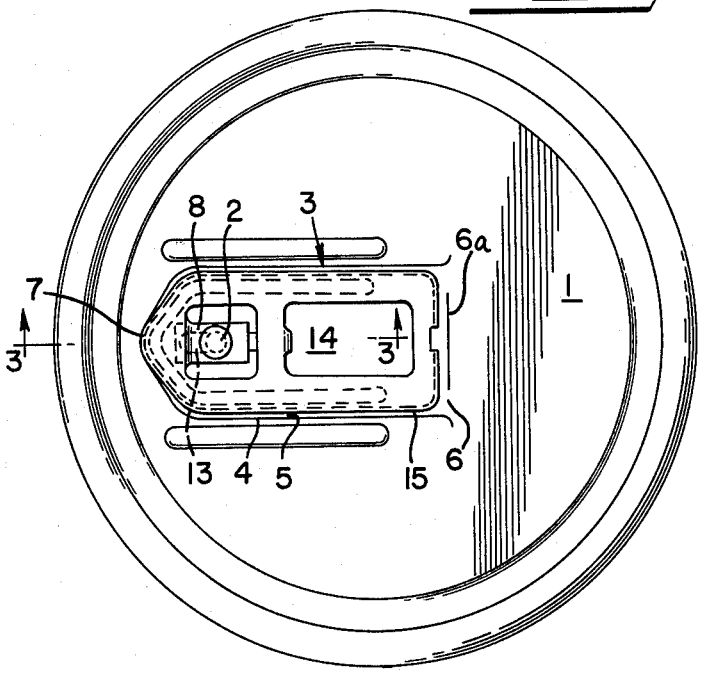
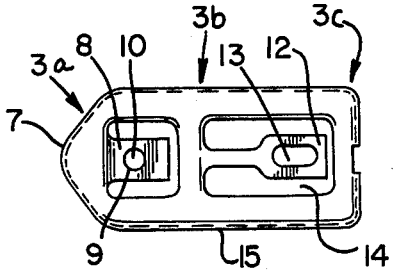
FIG. 2
FIG. 3
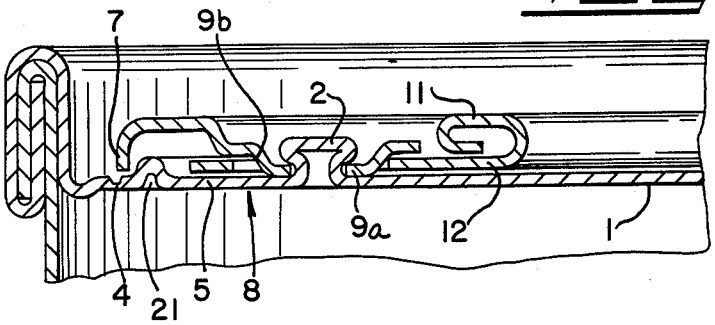
FIG. 4
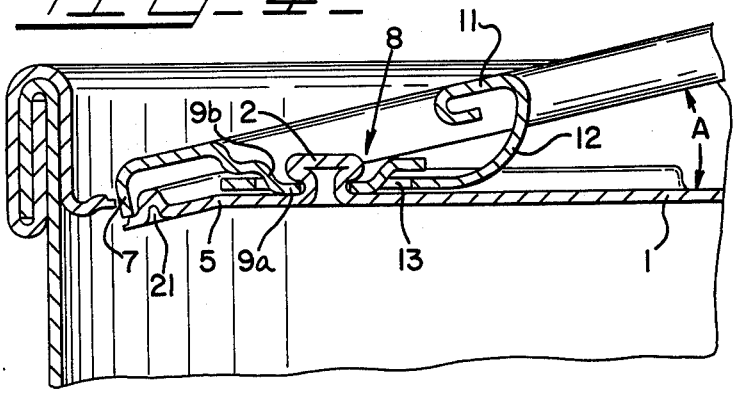

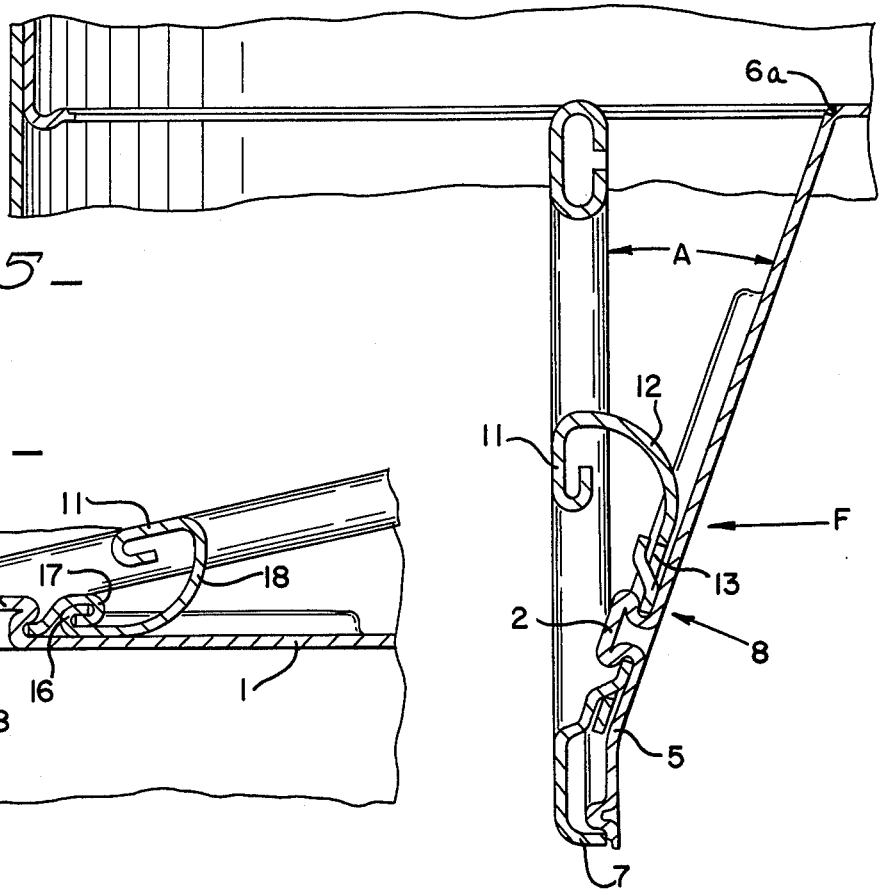
FIG. 5
FIG. 6
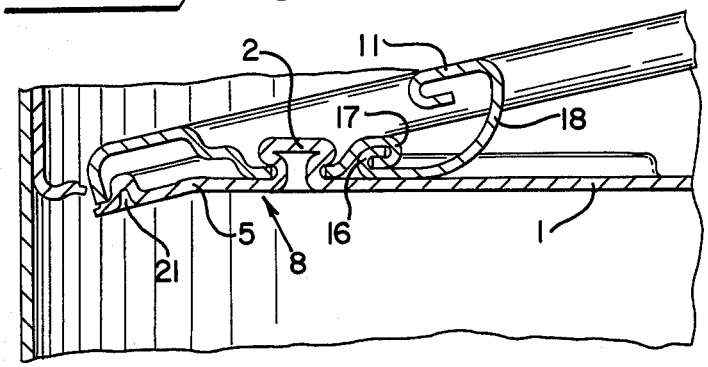
FIG. 7
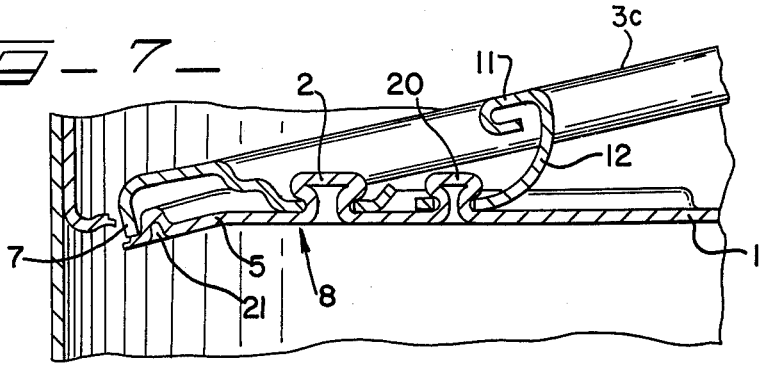
FIG. 8
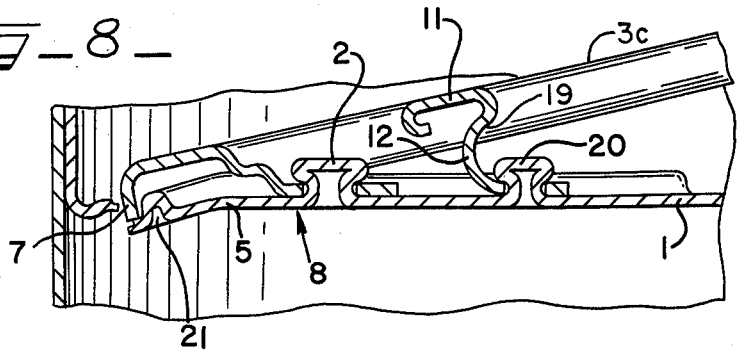

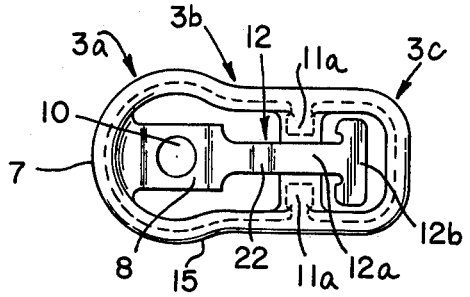
FIG. 9
FIG. 10
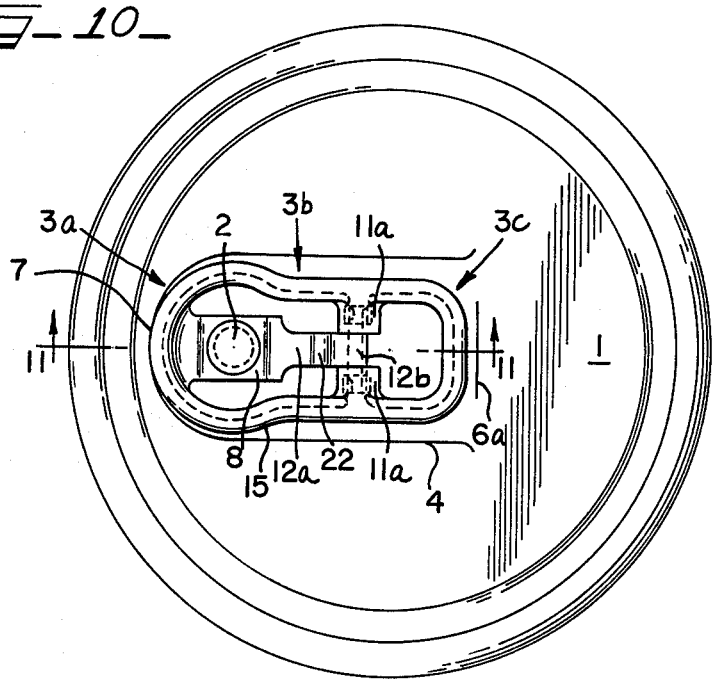
FIG. 11
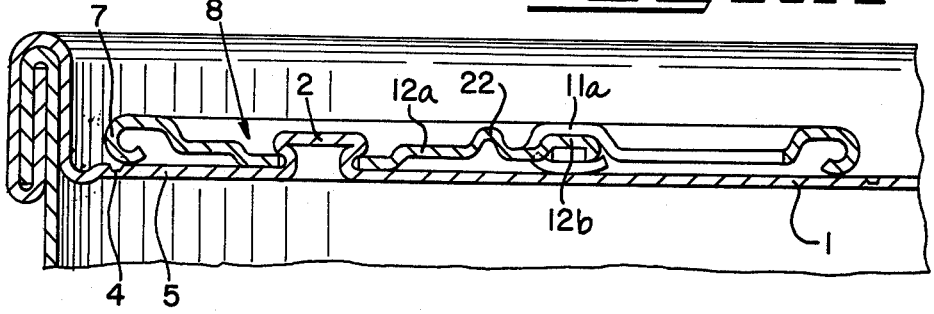

NON-OBSTRUCTING END CLOSURE

This is a continuation, of Serial No. 737,928, filed Nov. 2, 1976, abandoned which in turn was a Continuation-In-Part of Serial No. 684,620 filed May 10, 1976, abandoned.

BACKGROUND AND SUMMARY OF THE INVENTION

The present invention relates to containers and the like and is particularly concerned with containers having easy-open closure means.

In an effort to overcome the problems of litter, easy-open closures have been developed wherein the flap remains attached to the remainder of the closure subsequent to opening. This is generally accomplished by providing an unscored area in the flap periphery which serves as an integral hinge and connector. Upon opening, the flap is pushed into the interior of the containers.

Unfortunately, end closures of the type just described suffer in that opening thereof causes an angular displacement of the pull tab relative to the flap. resulting in protrusion of the tab through the flap opening and obstruction of the opening. Pouring and drinking directly from the container are thus hampered.

Furthermore, the tab of the conventional nondetachable end closure may be torn from the flap by accident or through repeated manipulation thereof by young children. In this respect, the conventional closure as described is not truly non-detachable.

Various end closures have been developed employing multiple attachment means to secure the tab to the flap, for example, Hannan U.S. Pat. No. 3,894,651. Closures of this type are frequently difficult or impossible to open by women or small children who are unable to initially lift the tab.

It is therefore a primary object of the present invention to provide an improved non-detachable type end closure wherein the pull tab is retained in a non-obstructing position subsequent to opening of the closure but which provides ease in initial partial lifting of the tab to permit full digit insertion by the user into the ring and application of full opening load.

It is another object to provide an improved end closure having increased resistance to tab removal.

It is still another object to provide an improved non-detachable end closure which is readily openable.

Reference is herein made to my co-pending U.S. application Ser. No. 684,686, filed May 10, 1976, now U.S. Pat. No. 4,008,825, issued Feb. 22, 1977.

BRIEF DESCRIPTION OF THE DRAWINGS

With the above and other objects in view that will hereinafter appear, the nature of the invention will be more clearly understood by reference to the following description when viewed in light of the accompanying drawings, in which:

FIG. 1 is a fragmentary top plan view of one embodiment of the present invention.

FIG. 2 is a top plan view of the pull tab of the closure of FIG. 1 prior to assembly to the end panel.

FIG. 3 is a fragmentary cross-section view taken substantially along line 3—3 of FIG. 1, illustrating the end closure in the unopened condition.

FIG. 4 is a fragmentary cross-sectional view similar to FIG. 3, illustrating the end closure in a partially opened condition.

FIG. 5 is a fragmentary cross-sectional view similar to FIG. 4, illustrating the end closure in the fully opened condition.

FIG. 6 is a fragmentary cross-sectional view illustrating an alternate embodiment of the present invention.

FIG. 7 is a fragmentary cross-sectional view illustrating yet another alternate embodiment of the present invention.

FIG. 8 is a fragmentary cross-sectional view illustrating still another alternate embodiment of the present invention.

FIG. 9 is a top plan view of a blank for a pull tab for yet another embodiment of the present invention.

FIG. 10 is a top plan view of a pull tab produced from the blank illustrated in FIG. 9 and attached to a container end panel.

FIG. 11 is a fragmentary cross-sectional view taken substantially along line 11-11 of FIG. 10.

DESCRIPTION OF THE FIRST PREFERRED EMBODIMENT FIGS. 1–5

Figure 12:
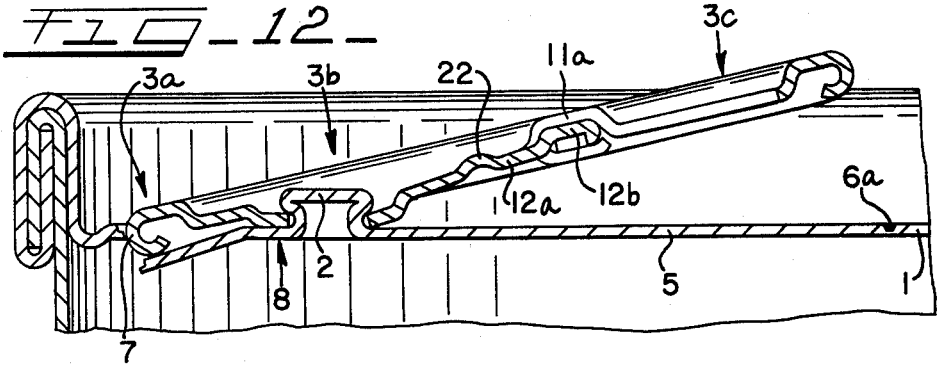
FIG. 12 is a fragmentary cross-sectional view of the end closure of FIG. 11 in a partially opened condition.
Figure 13:
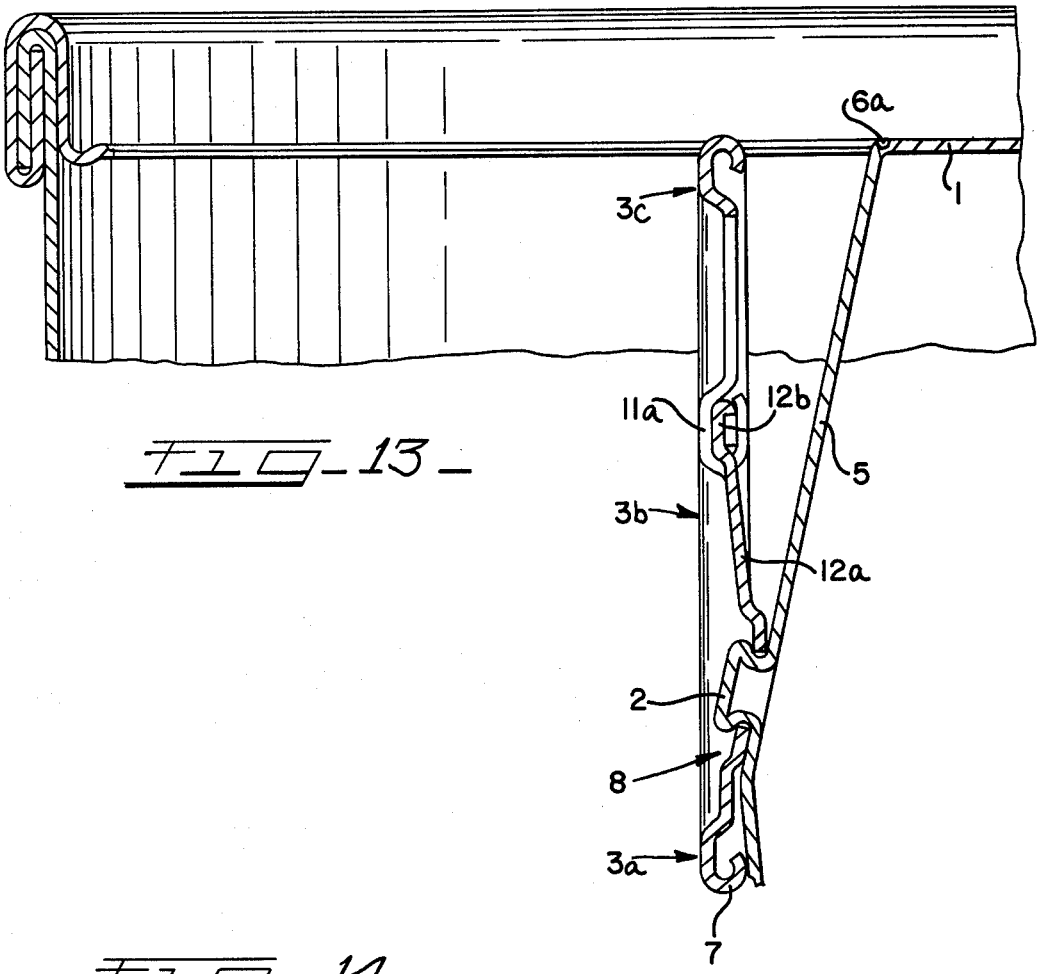
FIG. 13 is a fragmentary cross-sectional view, similar to FIG. 12 illustrating the closure in a fully opened condition.
Figure 14:
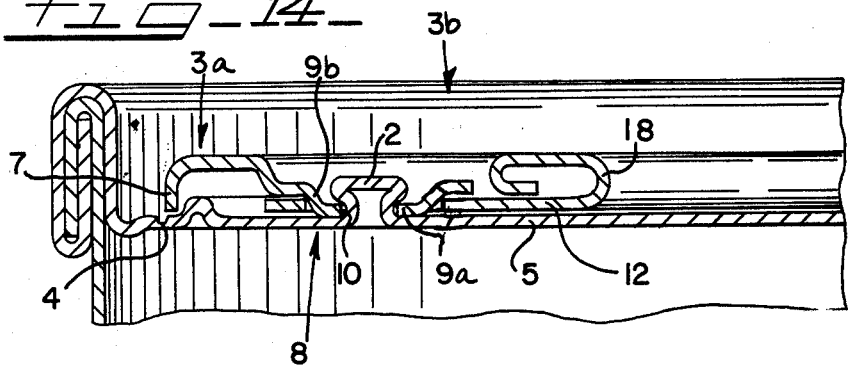
FIG. 14 is a fragmentary cross-sectional view illustrating a further alternate embodiment of the present invention.

As shown in the drawings, the improved easy-open end closure of this invention comprises an end panel 1 having an integrally formed rivet 2 and a pull tab 3 fixedly attached to the end panel 1 by the rivet 2. A score line 4 is formed in the end panel 1 and partially encircles an opening flap 5 with the unscored portion 6 of the flap perimeter hingedly attaching the flap to the remainder of said end panel 1 subsequently to rupture of the score line 4. A weakening line **6*a* may be formed in the unscored portion 6** to facilitate hinging during opening.

As best shown in FIG. 2, the pull tab 3 comprises a nose portion **3*a*, an intermediate portion 3*b* and a grasping or ring-pull portion 3*c***.

The nose portion **3*a* includes a rupturing member 7 overlying the score line 4, and an integrally formed hingeable recessed rivet panel 8. An edge portion 9, which may comprise a recess including a sidewall 9*b* and base 9*a*, is formed in the panel 8. Located in the base 9*a*, is a hole 10 of a size to admit the shank of the rivet 2**, but not the rivet head.

The intermediate portion **3*b* includes an integral bridge member 11 oriented transverse to the axis of the tab 3 and a strap 12 integrally joined to the bridge member 11 on the side thereof away from the nose portion 3*a*. A slot 13 is formed in the strap 12, elongated along the axis of the tab 3 and being of a size to permit passage of the edge portion 9** therethrough.

The grasping portion **3*c* comprises a substantially C-shaped handle member which combines with the intermediate portion 3*b* to define an aperture 14 through the tab 3. During the formation of the tab 3 from a single metal sheet, the strap 12** is formed of material normally occupying the grasping portion aperture.

A panelwardly directed rigidifying curl 15 is formed in the periphery of the tab 3 and protects the user from possible injury resulting from contact with the sharp edges of the tab.

In assembly of the end closure, the strap 12 is folded under the bridge member 11 and toward the nose portion 3*a*. The edge portion 9 enters the slot 13 and abuts the end thereof remote from the nose portion 3*a*. The rivet 2 passes through the slot 13 and the hole 10.

To open the closure, the grasping portion 3*c* of the tab 3 is lifted away from the end panel 1, thereby impressing a panelward force on the rupturing member 7 of the nose portion 3*a* and resulting in rupture of the score line 4. Continued lifting of the grasping portion 3*c* results in controlled tearing of the end panel 1 along the score line 4. During this operation, the flap 5 is forced into the interior of the container, hinging about a bend line 6*a* joining the ends of the torn portion of the score line 4.

As the tab 3 is lifted, the included angle A between the tab 3 and the flap 5 increases, causing the strap 12 to move relative to the rivet 2 until the end of the slot 13 nearer the nose portion 3*a* abuts the edge portion 9. At this point, angular displacement of the tab 3 relative to the flap 5 ceases. The strap 12 is preferably of a length to permit an angle A of about 30°. The center of force application on the flap 5 now moves to a point F located between the rivet 2 and the bridge member 11 whereby the opening force is redirected and a rearward force component is provided which facilitates full opening of the closure by urging the flap 5 inwardly and rearwardly to a non-obstructing position. During this movement, the bulk of the tab 3 enters into the container, hinging about the unscored portion 6 of the flap perimeter. It has been found necessary to rigidify the flap 5, as by a bead 21, to insure proper opening without bending.

The extent of the tab displacement is thus limited by the length of the slot 13. By limiting the slot length, the protrusion of the grasping portion 3*c* of the tab 3 from the opened flap 5 is minimized, whereby tab obstruction of the opening is prevented, thereby further facilitating pouring and drinking directly from the container.

Further, by limiting displacement of the tab 3 relative to the flap 5, repeated fatigue-inducing bending of the tab 3 is prevented. Also, displacement of the tab 3 in directions other than that intended are inhibited. Thus, the probability of separation of the tab 3 from the end panel 1, by inadvertence or the acts of young children, is reduced.

DESCRIPTION OF THE SECOND PREFERRED EMBODIMENT FIG. 6

This embodiment differs from that above described in that the slot 13 in the strap 12 is omitted. An upwardly directed curl 16 is formed on the distal end of the strap 12 and a panelwardly directed curl 17 is formed on the distal end of the rivet panel 8. The two curls 16 and 17 are interlocked and crimped to join the strap 12 to the panel 8. A loop 18 in the folded strap 12 provides a measure of slack. The amount of slack in the strap 12 determines the amount of angular displacement of the tab 3.

DESCRIPTION OF THE THIRD PREFERRED EMBODIMENT FIGS. 7 AND 8

In this embodiment the distal end of the strap 12 is fastened directly to the flap 5. Various attachment methods, including a second rivet 20, are contemplated for this purpose. As mentioned before, the amount of slack in the strap 12 determines the amount of angular displacement of the tab 2 relative to the flap 5. The point of attachment of the strap 12 to the flap 5 may be intermediate the bridge member 11 and the rivet 2 or, as best illustrated in FIG. 8, beneath the grasping portion 3C of the tab 3. In the latter case, the necessary slack is provided by an unfoldable pleat 19 formed in the strap 12 transverse to the axis thereof.

DESCRIPTION OF THE FOURTH PREFERRED EMBODIMENT FIGS. 9-13

In this embodiment, the strap 12 is integrally attached to the rivet panel 8, and comprises a comparatively narrow body 12*a* having a comparatively wider bridge section 12*b* at the distal end thereof.

The bridge member 11 comprises a pair of bridge base segments 11*a*, transversely spaced relative to a longitudinal axis of the tab 3, to which is attached the bridge section 12*b* of the strap 12 as will be more fully described below.

As best seen in FIG. 9, the pull tab 3 of this embodiment of the present invention is formed from a blank wherein the strap body 12*a* extends between the bridge base segments 11*a* and the strap bridge section 12*b* lies within the confines of the grasping portion 3*c*

In the course of fabricating the finished pull tab 3, a transverse bead 22 is formed in the strap body 12, reducing the length thereof and drawing the strap bridge section 12*b* to a position underlying the bridge base segments 11*a* and bridging the gap therebetween.

The strap 12*a* is attached to the bridge member 11*a* by panelwardly directed curls 11*b*, formed on the transverse edges of the base segments 11*a*, which crimp bridge section 12*b* in place. During opening of the closure, the bead 22 unfolds, thereby providing the necessary slack in the strap 12.

This pull tab configuration offers an advantage as compared to those herein previously described, in that a tab having a shorter overall length may be produced and a savings in tab stock thereby effected.

DESCRIPTION OF THE FIFTH PREFERRED EMBODIMENT FIG. 14

This embodiment differs from the first described in that the slot 13 in the strap 12 is omitted and the opening 13*a* is of a diameter more closely confining the wall portion 9*b*. A loop 18 in the folded strap 12 provides a measure of slack. Once again, the amount of slack in the strap 12 determines the amount of angular displacement of the tab 3.

I CLAIM:

1. For a container having an end panel, an improved nondetachable self-opening end closure of the push-in type including a tab wherein the tab and closure are pushed into the container to provide, upon opening, an unobstructed passageway through the end panel; said end panel having a score line including portions flanking the tab of an extent greater than the length of the tab and defining an opening flap and also having tab securing means, said pull tab comprising a nose portion, an intermediate portion and a grasping portion, said nose portion having means for pressing said flap inwardly thereby rupturing said score line consequent to a predetermined displacement of said pull tab relative to said end panel, said tab having an integrally formed hingeable rivet panel cooperating with said securing means to attach said tab to said end panel, said intermediate portion including combined displacement-limiting retention and force redirecting means cooperating with one of said flap and said rivet panel during opening of the container to limit the angular displacement of said pull tab relative to said flap and to redirect the opening force and thereby upon upward pull urging the tab with the flap into the container to a non-obstructing position substantially completely beneath said end panel

2. The invention according to claim 1, wherein said combined means comprises a bridge member oriented transverse the axis of said pull tab, and a strap attached to said bridge member.

3. The invention according to claim 2 wherein said pull tab is completely formed from a single piece of sheet metal, and said strap is provided, at least partially, by metal displaced to form the grasping portion thereof.

4. The invention according to claim 2, wherein said strap is integrally attached to said rivet panel.

5. The invention according to claim 4, wherein said bridge member comprises at least one pair of base segments, transversely spaced relative to a longitudinal axis of said pull tab, and said strap is attached to said base segments, bridging the gap between members of a pair.

6. The invention according to claim 5 wherein said tab is completely formed from a single piece of sheet metal, and said strap is provided in part by metal displaced to form the grasping portion of the tab, and in part by metal displaced to form the space between said segments of said bridge member.

7. The invention according to claim 6, wherein said strap is formed with at least one transverse bead, whereby a measure of slack is provided therein, prior to opening of said end closure, the amount of slack determining the angular relation of said pull tab and said flap subsequent to opening.

8. An improved nondetachable self-opening end closure of the push-in type especially arranged and constructed to provide an unobstructed passageway therethrough upon opening, comprising a pull tab and an end panel, said end panel having a score line formed therein defining an opening flap and also having tab securing means, said pull tab comprising a nose portion, an intermediate portion and a grasping portion, said nose portion having means for rupturing said score line consequent to a predetermined displacement of said pull tab relative to said end panel and further having an integrally formed hingeable rivet panel cooperating with said securing means to attach said tab to said end panel, said intermediate portion including displacement-limiting retention means cooperating with one of said flap and said rivet panel to limit the angular displacement of said pull tab relative to said flap and to redirect the opening force whereby said pull tab is urged to a non-obstructing position upon opening, wherein said retention means comprises a bridge member oriented transverse the axis of said pull tab, and a strap attached to said bridge member, wherein said pull tab is completely formed from a single piece of sheet metal, and said strap is provided by metal displacement to form the grasping portion thereof, and wherein said strap is folded under said bridge member and toward said nose portion.

9. The invention according to claim 8, wherein said securing means comprises a rivet integrally formed in said flap.

10. The invention according to claim 9, wherein said strap means is formed with a slot oriented along the axis of said pull tab and said rivet passes through said slot.

11. The invention according to claim 10, wherein said rivet abuts the end of said slot further from said nose portion when said end closure is in the unopened condition and said rivet abuts the end of said slot proximate said nose portion when said end closure is in the opened condition, the movement of said strap means relative to said edge portion permitting a predetermined limited angular displacement of said tab relative to said flap.

12. The invention according to claim 8, wherein said strap is in a slack state prior to opening said end closure, the amount of slack determining the angular relation of said pull tab and said flap subsequent to opening said end closure.

13. The invention according to claim 8, wherein said strap is formed with an upwardly directed curl on the distal end thereof, and said panel member is formed with a panelwardly directed curl on the distal end thereof, said curls engaging to joint said strap to said panel member.

14. The invention according to claim 8, wherein said strap is riveted to said end panel.

15. The invention according to claim 11, wherein said angular displacement is between 20° and 40°.

16. The invention according to claim 15, wherein said angular displacement is substantially 30°.

17. An improved non-detachable end closure for use on a can or similar container comprising an end panel having a score line defining an elongated opening flap therein, a liftable pull tab of lesser length than said flap attached to said flap by attachment means and positioned over the flap between opposing portions of the score line and having means for rupturing said score line to open said flap by displacement thereof into the container to provide a pouring area, and combined retention and force directing means associated with said pull tab and attached to one of said flap and said end panel for limiting, upon lifting of the tab, the angular displacement of said pull tab relative to said flap and for thereafter forcing said pull tab and said flap into the container to a position of minimal protrusion of said pull tab and said flap into the pouring area of the opened end.

18. The invention according to claim 17, wherein said pull tab comprises a nose portion, an intermediate portion and a grasping portion, and said retention means comprises a strap member attached to said intermediate portion on the side thereof away from said nose portion, said strap being folded beneath said tab and toward said nose portion.

19. The invention according to claim 17, wherein said pull tab comprises a nose portion, an intermediate portion and a grasping portion, and said retention means comprises a strap member integrally attached to said intermediate portion, the distal end of said strap being connected to said nose portion.

20. The invention according to claim 18, wherein said strap is in a slack state prior to opening said end closure, and being stretchable taut to limit the angular displacement of said pull tab relative to said flap subsequent to opening said end closure.

21. The invention according to claim 18, wherein said pull tab attachment means comprises a rivet and said strap member is formed with a slot oriented along the axis of said pull tab, said rivet passing through said slot accommodating a predetermined angular displacement of said pull tab relative to said end panel.

22. The invention according to claim 18, wherein said pull tab attachment means includes a panel member integrally formed in said nose portion of said tab, said panel member having a panelwardly directed curl in the distal end thereof, said strap having an upwardly directed curl on the distal end thereof, said curls engaging to joint said strap to said end panel member.

23. The invention according to claim 18, wherein said strap is riveted to said flap.

24. An improved non-detachable end closure for use on a can or similar container comprising an end panel having a score line defining an opening flap therein, a pull tab attached to said flap by attachment means and having means for rupturing said score line to open said flap by displacement thereof into the container to provide a pouring area, and retention means integrally formed in said pull tab and attached to one of said flap and said end panel to limit the angular displacement of said pull tab relative to said flap whereby said pull tab follows said flap into the container and protrusion of said pull tab and said flap into the pouring area of the opened end closure is minimized, wherein said pull tab comprises a nose portion, an intermediate portion and a grasping portion, and said retention means comprises a strap member integrally attached to said intermediate portion, the distal end of said strap being connected to said nose portion, wherein said intermediate portion includes at least one pair of bridge base segments transversely spaced relative to a longitudinal axis of said pull tab, and said strap member is attached to said base segments, bridging the gap between members of a pair.

25. The invention according to claim 24, wherein said pull tab is formed from a single piece of sheet metal, and said strap member is provided in part by metal displaced to form the grasping portion of the pull tab, and in part by metal displaced to form the space between said bridge base segments.

26. An improved non-detachable end closure for a can or similar container comprising an end panel and a pull tab and said end panel having a score line defining an opening flap therein wherein said tab and flap enter into the container, said pull tab comprising a nose portion, a grasping portion and a tether, said tether having a slack connection to said end panel providing means operable upon lifting said grasping portion to stretch and thereby accommodate movement of said nose portion to fracture said score line and force said flap and tab inwardly, said strap positioned to be thereafter operative to redirect the opening force to urge said pull tab and said flap substantially completely into the container in a non-obstructing position within the pour opening.

27. A pull tab for use with an end panel having a score line defining an openable flap, said pull tab comprising a nose portion, an intermediate portion and a grasping portion, said nose portion having means for rupturing said score line consequent to a predetermined displacement of said pull tab relative to said end panel and further having an integrally hingeable rivet panel for attaching said pull tab to said end panel, said intermediate portion including displacement-limiting retention means cooperating with one of said flap and said rivet panel to limit the angular displacement of said pull tab relative to said flap and to redirect the opening force whereby said pull tab is urged to a non-obstructing position upon opening, said retention means comprising a bridge member oriented transverse the axis of said pull tab and a strap attached to said bridge member, said pull tab being completely formed from a single piece of sheet metal, said strap being provided, at least partially, by metal displaced to form the grasping portion of said pull tab said strap being folded under said bridge member and toward said nose portion.

28. A pull tab for use with an end panel having a score line defining an openable flap, said pull tab comprising a nose portion, an intermediate portion and a grasping portion, said nose portion having means for rupturing said score line consequent to a predetermined displacement of said pull tab relative to said end panel and further having an integrally hingeable rivet panel for attaching said pull tab to said end panel, said intermediate portion including displacement-limiting retention means cooperating with one of said flap and said rivet panel to limit the angular displacement of said pull tab relative to said flap and to redirect the opening force whereby said pull tab is urged to a non-obstructing position upon opening, said retention means comprising a bridge member oriented transverse the axis of said pull tab and a strap attached to said bridge member, said pull tab being completely formed from a single piece of sheet metal, said strap being provided, at least partially, by metal displaced to form the grasping portion of said pull tab, wherein said bridge member comprises at least one pair of base segments, transversely spaced relative to a longitudinal axis of said pull tab, and said strap is attached to said base segments, bridging the gap between members of a pair.

* * * * *